United States Patent [19]

Anderson

[11] Patent Number: 4,508,993

[45] Date of Patent: Apr. 2, 1985

[54] FLUORESCENT LAMP WITHOUT BALLAST

[75] Inventor: John M. Anderson, Scotia, N.Y.

[73] Assignee: General Electric Company, Schenectady, N.Y.

[21] Appl. No.: 538,694

[22] Filed: Oct. 3, 1983

Related U.S. Application Data

[63] Continuation of Ser. No. 324,925, Nov. 25, 1981, abandoned.

[51] Int. Cl.[3] ..... H01J 7/44

[52] U.S. Cl. ..... 315/59; 313/493; 313/611; 315/73; 315/180; 315/181

[58] Field of Search ..... 315/73, 180, 181, 59; 313/611, 493

[56] References Cited

U.S. PATENT DOCUMENTS

| | | | |
|---|---|---|---|
| 1,740,030 | 12/1929 | Nagadka et al. | 313/611 |
| 1,759,434 | 5/1930 | Case | 313/204 |
| 1,820,027 | 8/1931 | McClintock | 313/26 |
| 1,826,382 | 10/1931 | Claude | 313/611 |
| 1,930,132 | 10/1933 | Reger | 313/611 |
| 1,946,726 | 2/1934 | Barclay | 313/611 |
| 2,198,513 | 4/1940 | Knoop | 313/204 |
| 2,298,239 | 10/1942 | Stirnkorb | 313/611 |
| 2,367,595 | 1/1945 | Marden | 313/611 |

*Primary Examiner*—Harold Dixon

*Attorney, Agent, or Firm*—Mark L. Mollon; James C. Davis, Jr.; Marvin Snyder

[57] ABSTRACT

It is known that electrical discharges in capillary tubing shows a positive volt-ampere characteristic even for low pressure gas fills. In contrast, conventional fluorescent lamps exhibit a negative volt-ampere characteristic and, accordingly, require special ballast circuits for operation. In the present invention, a fluorescent lamp comprises a plurality of discharge tube sections which are connected by capillary tube sections to provide the necessary ballasting action to prevent lamp current runaway. In one embodiment of the present invention, the ballastless lamp is configured in a compact configuration which may include much simpler ballast components configured in a package similar to a conventional screw-in incandescent lamp.

1 Claim, 3 Drawing Figures

FLUORESCENT LAMP WITHOUT BALLAST

This application is a continuation, of application Ser. No. 324,925, filed 11-25-81, now abandoned.

BACKGROUND OF THE INVENTION

This invention relates to fluorescent lamps, and, in particular, to fluorescent lamp configurations which are self-ballasting.

Conventional fluorescent lamps exhibit what is known as a negative volt-ampere characteristic. That is to say, after discharge arc initiation between the lamp electrodes, increased current through the lamp results in lower lamp impedance and a corresponding drop in voltage across the lamp. An effect of this lowered impedance is the tendency of the current in the lamp to increase to undesirable levels. To prevent this from occurring, conventional fluorescent lamp circuits employ a ballasting device or circuit to provide current limitation. Such ballasts are often in the form of relatively heavy and costly magnetic coils with high magnetic permeability core material. The presence of a relatively large inductor in the lamp circuit acts to limit the lamp current. However, the negative volt-ampere characteristic of the lamp requires such ballasting circuits and, accordingly, conventional fluorescent lamps must generally be provided in long luminaire structures with separate ballasting devices. Accordingly, because of the required lamp structures, fluorescent lamps are generally incompatible with conventional incandescent lamp sockets and fixtures.

While it is true that fluorescent lamps exhibit a negative volt-ampere characteristic, it is also well known that electrical discharges in capillary tubing exhibit a positive volt-ampere characteristic, even for low pressure gas fills of approximately 1 torr. The reason for this characteristic is not completely understood although it is felt that it is due to electron-ion momentum scattering. One consequence of such a positive volt-ampere characteristic is that a discharge in such a capillary tube may be operated directly from a firm voltage source without a ballast. However, lamps consisting of capillary tubing only are impractical for several reasons. First, such lamps are hard to restart each half cycle because of rapid cleanup of discharge products at the alternating supply current passes through its zero value. Second, even though the mercury radiation from such lamps is relatively bright to the eye, the overall lumen efficacy under these conditions is also known to be low. Third, the current density in these lamps is also high since the cross-sectional area is low. In fact, the current density approaches 100 amperes per square centimeter. For these reasons, there is considerable segregation of the mercury by thermal and cataphoretic effects. Additionally, mercury radiation along the length of the capillary tubing is nonuniform. After a few minutes, the mercury is driven to the ends of the tube because this is the cooler region and the discharge reverts to a rare gas only discharge. Thus, while capillary tubing discharges are known to possess a positive volt-ampere characteristic and are also capable of directly operating from a conventional alternating current power line, such capillary structures do not, by themselves, provide good lamps.

SUMMARY OF THE INVENTION

In accordance with a preferred embodiment of the present invention, a fluorescent lamp comprises a plurality of evacuable, light-transmissive discharge tube sections having a relatively large diameter together with a plurality of evacuable capillary sections having a relatively small diameter with each capillary section joining an adjacent pair of relatively large diameter discharge tube sections. These alternating sections of large discharge tube and small capillary tube are in gaseous communication with one another. The lamp of the present invention also comprises an ionizable discharge medium disposed in the discharge and tube capillary tube sections, and a pair of electrodes located within distinct discharge tube sections at opposite ends of the lamp. In accordance with one embodiment of the present invention, the discharge tube sections are configured in the shape of cylinders with their axes substantially parallel and with capillary tubes connecting the cylinders so as to form a single path from one electrode to another electrode at the opposite end of the lamp. Furthermore, such a structure may be disposed in an outer protective envelope. A phosphor coating is also employed disposed either on the outer envelope or within the discharge tube sections themselves. Such a lamp may be configured to approximate the size and shape of a conventional incandescent lamp and, because the lamp of the present invention requires either no ballasting or a very simple ballasting circuit, the lamp of the present invention may be substituted in most conventional incandescent lamp fixtures.

Accordingly, it is an object of the present invention to provide a fluorescent lamp which does not require a separate ballasting circuit.

It is also an object of the present invention to provide a lamp capable of replacing many incandescent lamp structures.

It is a further object of the present invention to provide a lamp exhibiting a high lumens per watt rating, that is, a high efficacy rating.

Lastly, it is an object of the present invention to provide a fluorescent lamp which requires only a simple ballast circuit.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
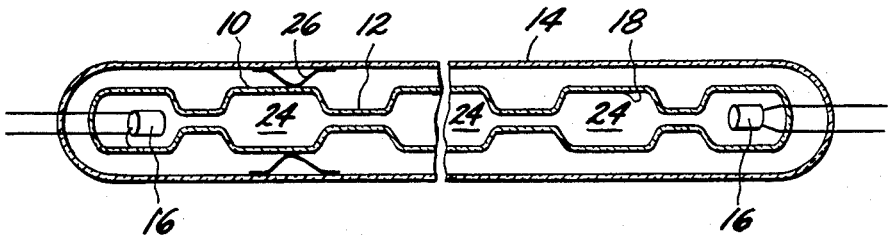
FIG. 1 is a partial cross-sectional side elevation view illustrating one embodiment of the present invention.

FIG. 1 illustrates one embodiment of the present invention in which relatively large diameter discharge tube sections 10 are connected with one another, in an alternating fashion, through a plurality of evacuable capillary tube sections 12 having a relatively small diameter. Each capillary section 12 joins an adjacent pair of relatively large diameter discharge tube sections so that the large diameter sections are in gaseous communication with one another and with the capillary tube sections. Each capillary tube section is preferably about 2 millimeters in inside diameter or less. The string of alternating capillary and more conventionally-sized discharge tubes is terminated at each end with a substantially conventional diameter discharge tube section having electrodes 16 disposed therein. These electrodes are preferably of the hollow cathode type for the embodiment shown. Furthermore, the embodiment of the present invention shown in FIG. 1 is preferably enclosed within an outer light-transmissive envelope 14. Further, disposed within the discharge tube sections 10 and capillary sections 12 is an ionizable medium 24 preferably comprising a fill of a rare gas mixture such as xenon or argon together with mercury vapor.

The small diameter capillary tube segments provide the positive volt-ampere characteristic needed to prevent current runaway, while the relatively larger diameter discharge tube segments are internally phosphor coated and function as in normal fluorescent lamps, with relatively high lumen efficacy. As indicated above, long lengths of capillary tubing make restarting capillary tube lamps quite difficult after each half cycle. However, in the present lamp, charge decay is so gradual in the larger diameter segments that lamp restart is not a problem. Thus the large diameter segments retain charges which feed into each short capillary segment from both ends and aid in restarting. Therefore, a sufficient number of short capillary tubes still provide the positive volt-ampere characteristic needed for ballasting while the large diameter discharges exhibit, as usual, a somewhat negative volt-ampere characteristic. Moreover, in the lamp shown, there is little mercury segregation because the large diameter discharge tube segments are at a lower wall temperature and would therefore be repositories for mercury, especially if the end discharge tube sections are kept warm.

The electrodes can start an arc discharge without preheating, but if this is found to be difficult because of particular design criteria used in fabricating a certain lamp, a small auto transformer in the lamp base is sufficient to provide heat to the electrodes. The lamp of the present invention requires only a few watts for this purpose. However, initial starting of such a lamp is a more significant problem. However, the same auto transformer, connected with snap diodes or the like, is sufficient to provide a voltage pulse of a few hundred volts each half cycle to provide easy lamp start and restart.

In the lamp illustrated in FIG. 1, it is preferable that a protective glass or plastic sleeve 14 be provided because capillary segments 12 have a tendency to run hot and are fragile. However, the lamp of the present invention may also be configured in a folded form, more particularly illustrated in FIG. 2, discussed below.

Figure 2:
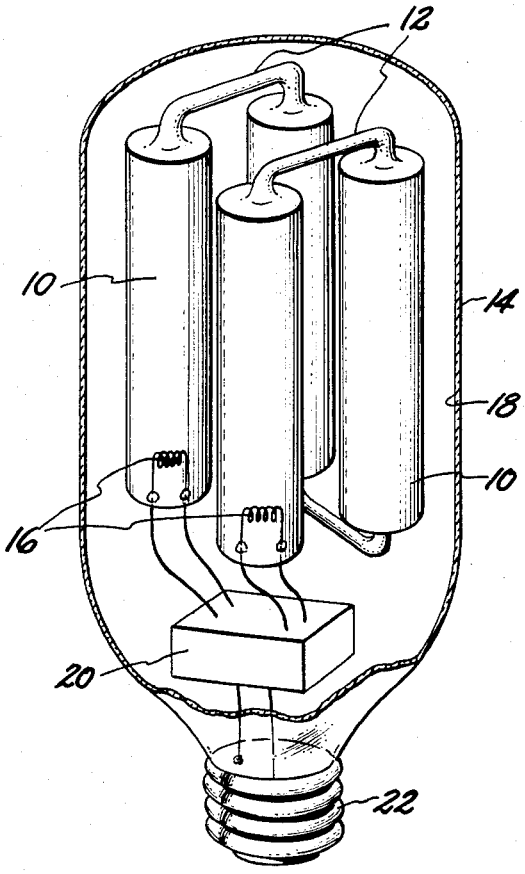
FIG. 2 is an isometric view illustrating the applicability of employing ballasting capillary tube sections to configure a fluorescent lamp in the general shape and mounting structure for an incandescent lamp.

In FIG. 2, there are shown a plurality, namely, four, of relatively large diameter discharge tubes 10 connected in series fashion, as above, by capillary tubes 12 having a relatively small inner diameter. It should also be noted that in the embodiment shown here and in FIG. 1, that strength may be added to the series configuration by providing capillary tubes exhibiting relatively thick walls. In the folded configuration of FIG. 2, discharge tube sections 10 and capillary tube sections 12 are preferably disposed within outer protective glass or ceramic or plastic envelope 14. Also, at the ends of two of the discharge tube segments, there are disposed electrodes 16. These may be conventional filamentary electrodes as are typically employed in fluorescent lamps or may include a hollow cathode structure such as that shown in FIG. 1. Envelope 14 is also preferably provided with conventional screw-in Edison base 22 for insertion into the usually-employed incandescent lamp sockets. Furthermore, if desired, a simple ballast circuit 20 may also be disposed in the base of envelope 14. Such a simplified ballast structure typically includes an autotransformer for starting. The auto transformer may also be replaced by simple electronics to provide the same function of filament heating and starting.

If the relatively large discharge tube sections comprise an ultraviolet transmitting glass or quartz, phosphor 18 may be placed on the outer envelope. In this position, the lamp operates cooler. However, phosphor 18 may also be disposed on the inner surface of discharge tube segments 10 as is shown in FIG. 1.

Figure 3:
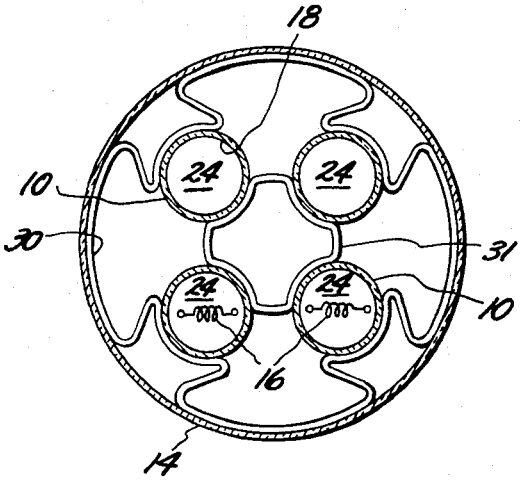
FIG. 3 is a cross-sectional plan view illustrating support structures which may be employed in the lamp of FIG. 2.

In FIG. 1 the alternating sections of large and small diameter tubes are shown supported by wire support structures 26 which hold the interior structure in a relatively fixed position within protective envelope 14. However, a somewhat different configuration is provided for the folded lamp illustrated in FIG. 2. In particular, FIG. 3 illustrates the use of flexible metal spring structures 30 and 31 for maintaining tube sections 10 in a relatively fixed position within envelope 14. Other structures, not shown, may be provided at the base end of the lamp.

From the above it may be appreciated that the present invention provides a self-ballasting fluorescent lamp, or a fluorescent lamp which requires a much simplified ballast circuit. The present invention also provides a folded lamp structure which may not only be employed as a substitute for conventional incandescent lamps, but which, nonetheless, exhibits superior light efficacy, typically about 35 lumens per watt or more. Not only may the lamp of the present invention be configured in the form of an incandescent lamp, but it may also be configured in the shape of a conventional fluorescent lamp tube and may be employed in conventional fluorescent lamp luminares but without the necessity of having to provide ballast circuitry.

While the invention has been described in detail herein, in accord with certain preferred embodiments thereof, many modifications and changes therein may be effected to those skilled in the art. Accordingly, it is intended by the appended claims to cover all such modifications and changes as fall within the true spirit and scope of the invention.

The invention claimed is:

1. A lamp operable without a ballast for regulating lamp current, comprising:

at least three evacuable, light-transmissive discharge tube sections have a relatively large diameter;

at least two evacuable capillary tube sections having a relatively small diameter, each capillary tube section joining an adjacent part of said relatively large diameter discharge tube sections and being in gaseous communication therewith;

an ionizable discharge medium disposed within said discharge tube sections and within said capillary tube sections;

a pair of electrodes disposed within distinct discharge tube sections at opposite ends of said lamp, said lamp having a positive volt-ampere characteristic across the lamp from electrode to electrode when there is an arc discharge through said discharge tube sections and said capillary tube sections;

starter means connected to said electrodes; and an outer light-transmissive phosphor coated envelope enclosing said discharge tube sections, said capillary tube sections and said starter means, said outer envelope being configured with a screw-in base, and said discharge tube sections being substantially cylindrical and being arranged in a configuration in which the cylindrical axes are substantially parallel.

* * * * *